US006105412A

United States Patent [19]

Müller

[11] Patent Number: 6,105,412

[45] Date of Patent: Aug. 22, 2000

[54] CONTINUOUS LIGHT-SECTION OR WIRE TRAIN

[75] Inventor: Alfred Müller, Krefeld, Germany

[73] Assignee: SMS Schloemann-Siemag Aktiengesellschaft, Düsseldorf, Germany

[21] Appl. No.: 09/388,709

[22] Filed: Sep. 2, 1999

[30] Foreign Application Priority Data

Sep. 19, 1998 [DE] Germany ..... 198 43 032

[51] Int. Cl.[7] ..... B21B 27/06; B21B 41/04

[52] U.S. Cl. ..... 72/201; 72/228

[58] Field of Search ..... 72/200, 201, 202, 72/227, 228, 230, 231, 365.2, 366.2

[56] References Cited

U.S. PATENT DOCUMENTS

| | | | |
|---|---|---|---|
| 351,840 | 11/1886 | Lenox | 72/228 |
| 3,383,896 | 5/1968 | Blinn | 72/228 |
| 3,422,654 | 1/1969 | Forsberg | 72/228 |

FOREIGN PATENT DOCUMENTS 0571789 12/1993 European Pat. Off. .

OTHER PUBLICATIONS

Stahl Und Eisen 108, pp. 75–80, 1988.

*Primary Examiner*—Rodney A. Butler
*Attorney, Agent, or Firm*—Friedrich Kueffner

[57] ABSTRACT

A continuous light-section or wire train includes finishing and sizing mill units arranged following the intermediate rolling section of the train, cooling sections and temperature equalization sections arranged in front of, between and following the finishing and sizing mill units, and rolling stock collecting devices arranged following the cooling sections and temperature equalization sections. The finishing mill unit includes two independent finishing mill units, wherein one finishing mill unit is arranged in a first rolling line which branches off from a second rolling line through a distributing guide arranged following the intermediate rolling section, followed by a temperature equalization section with cooling section extending past the finishing mill unit, another looper and another distributing guide following the looper leading into the second rolling line in front of the finishing mill unit, and wherein the other finishing mill unit is arranged together with a sizing mill unit in the second rolling line which extends parallel to the first rolling line.

6 Claims, 1 Drawing Sheet

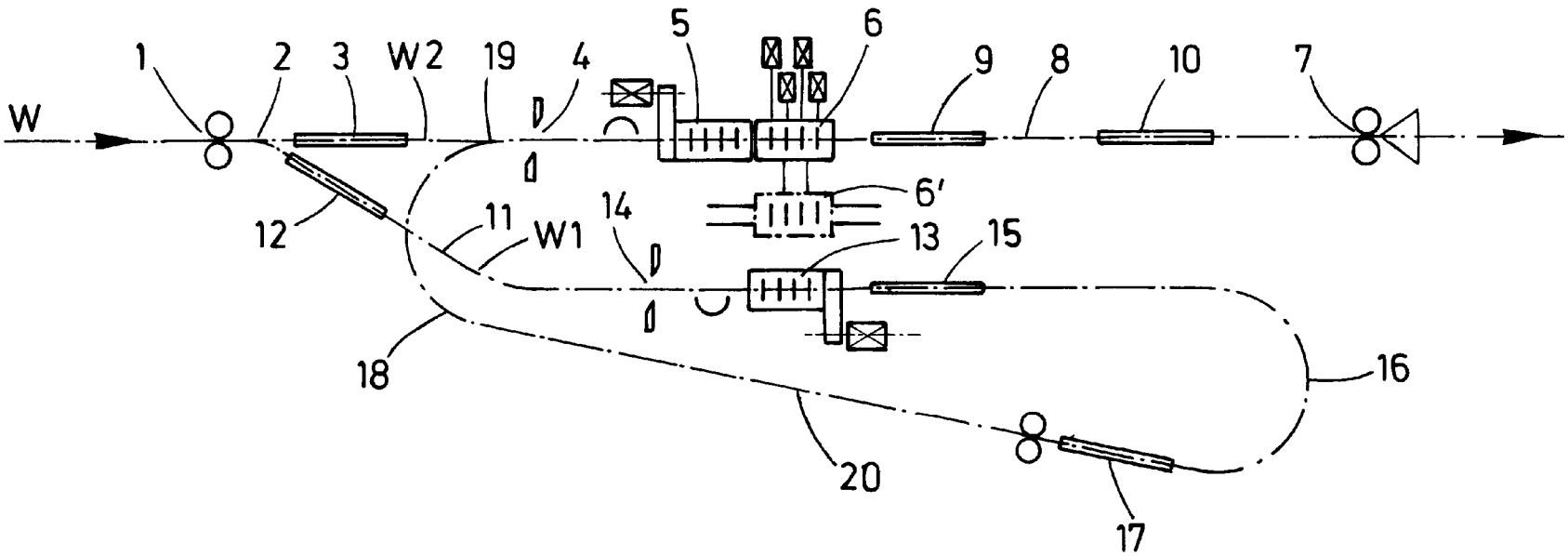
W
1
2
3
W2
19
4
5
6
9
8
10
7
12
18
11
W1
14
13
6'
15
20
17
16

CONTINUOUS LIGHT-SECTION OR WIRE TRAIN

BACKGROUND OF THE INVENTION

1. Field of the Invention

The present invention relates to a continuous light-section or wire train which includes finishing and sizing mill units arranged following the intermediate rolling section of the train, cooling sections and temperature equalization sections arranged in front of, between and following the finishing and sizing mill units, and rolling stock collecting devices arranged following the cooling sections and temperature equalization sections.

2. Description of the Related Art

Wire trains of the above-described type represent the prerequisite with respect to plant technology for a temperature-controlled rolling which makes it possible to improve the mechanical properties of the rolling stock (thermomechanical rolling), to eliminate thermal treatment processes following the rolling process, and to adjust controlled temperature profiles within the rolling line.

Because of the high final rolling speed during finish-rolling in the block finishing rolling units with short distances between the stands and because the rolling stock is heated during rolling, this thermomechanical rolling process makes high demands of the temperature guidance or control which usually requires a lowering of the temperature to certain values already prior to finish-rolling.

In a known rolling train disclosed in Stahl and Eisen 108, pages 75–80, a cooling section is arranged following the last stand of the intermediate train in a straight rolling line within a relatively long temperature equalization section and in front of the finishing rolling unit, wherein the cooling section is arranged approximately in the middle between the last stand of the intermediate train and the finishing rolling unit. Another cooling section is arranged following the finishing rolling unit, followed by a sizing mill unit, and several cooling sections arranged one behind the other are arranged between the sizing mill unit and the rolling stock collecting unit.

This above-described configuration makes it possible to maintain, modify and control the desired temperature profile; however, this configuration requires a large amount of space because of the long temperature equalization sections and the number of cooling sections.

SUMMARY OF THE INVENTION

It is the primary object of the present invention to provide a continuous light-section or wire mill of the above-described type which permits a temperature-controlled rolling while requiring substantially less space, starting from a conventional configuration of such a rolling train (EP 0 571 789 A1) in which a first equalization section with a 180° loop of the rolling stock guided through a first horizontal looper is arranged between the pilot stand and the intermediate stand group and a second equalization section with a 180° loop of the rolling stock guided through a second horizontal looper is arranged between the intermediate stand group and the finishing stand group.

In accordance with the present invention, the finishing mill unit includes two independent finishing mill units, wherein one finishing mill unit is arranged in a first rolling line which branches off from a second rolling line through a distributing guide arranged following the intermediate rolling section, followed by a temperature equalization section with cooling section extending past the finishing mill unit, another looper and another distributing guide following the looper leading into the second rolling line in front of the finishing mill unit, and wherein the other finishing mill unit is arranged together with a sizing mill unit in the second rolling line which extends parallel to the first rolling line.

In accordance with another feature of the present invention, one cooling section may be arranged in the second rolling line behind the distributing guide and in front of the finishing mill unit and the sizing mill unit, and two cooling sections may be arranged in the second rolling line following the finishing mill unit and the sizing mill unit.

In accordance with another feature, a cooling section each may be arranged in the first rolling line immediately following the finishing mill unit and in front of the first looper and another cooling section may be arranged following the first looper and in front of a temperature equalization section.

In addition, it is recommended to arrange shears in both rolling lines immediately in front of the respective finishing mill units.

In accordance with the present invention, the wire train constructed in the above-described manner can be operated by introducing the rolled wire strand arriving from the intermediate rolling section initially through the distributing guide into the first rolling line and from there into the finishing mill unit, and guiding the rolled wire strand through the loopers and the distributing guide into the second rolling line, and finishing-rolling the strand in the finishing mill unit and the sizing mill unit.

On the other hand, the rolled wire strand arriving from the intermediate rolling section can either be introduced in a straight travel line into the second rolling line and rolled in the finishing mill unit and the sizing mill unit or can be introduced through the distributing guide into the first rolling line, rolled in the finishing mill unit to reduce the cross-section, subsequently introduced through the loopers and the distributing guide into the second rolling line and, after a dummy pass through the finishing mill unit, finish-rolled in the sizing mill unit.

The configuration of the rolling train according to the present invention not only reduces the structural requirements for foundations and buildings because the total length of the plant is significantly reduced, but makes it possible to carry out the largest temperature decrease not already in front of the finishing mill unit, but in a temperature equalization section through two loopers with the additional possibility of using cooling sections between the finishing mill units. The temperature of the rolling stock is further reduced when it travels through the finishing mill unit and the sizing mill unit, so that the cooling section between the finishing mill unit and the sizing mill unit and the rolling stock collecting device can be kept shorter. In addition, contrary to the conventional rolling trains described above, it is possible to finish-roll thick rolling stock dimensions in a straight line in the finishing mill unit of the second rolling line with or without the use of the sizing mill unit, without requiring a simultaneous dummy pass through the other finishing mill unit in the first rolling line. However, this finishing mill unit can also be used first with subsequent finish-rolling in the sizing mill unit of the second rolling line.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are described preferred embodiments of the invention.

BRIEF DESCRIPTION OF THE DRAWING

The single FIGURE of the drawing is a schematic top view of a rolling mill plant according to the present invention.

DESCRIPTION OF THE PREFERRED EMBODIMENTS

A distributing guide 2 is arranged following the last stand 1 of an intermediate rolling section which is otherwise not illustrated. The rolling line W extends following the distributing guide 2 in a straight line into the rolling line W2. Arranged in this rolling line W2 are following the distributing guide 2 a cooling section 3, a shear 4 and, following the shear 4, the finishing mill unit 5 and the sizing mill unit 6 which are arranged immediately one behind the other. The units 5 and 6 are followed by a temperature equalization section 8, including two cooling sections 9 and 10, and a rolling stock collecting device 7.

The first rolling line W1 branches off behind the distributing guide 2 and includes a temperature equalization section 11, wherein a cooling section 12 is arranged at the beginning of the temperature equalization section 11. The rolling line W1 then continues to extend parallel to the rolling line W2. Arranged in the rolling line W1 at the end of the temperature equalization section 11 is the finishing mill unit 13 immediately next to the finishing mill unit 5. A shear 14 is arranged in front of the finishing mill unit 13. The rolling line W1 then includes a cooling section 15 which still extends parallel to the rolling line W2. The cooling section 15 is followed by the looper 16 and a cooling section 17 forming a temperature equalization section 20 at the exit of the looper 16. The rolling line W1 then extends at an angle relative to the rolling line W2 through another looper 18 and at the end of the looper 18 back into the rolling line W2 through a distributing guide 19 which is arranged following the distributing guide 2 and in front of the first finishing mill unit 5.

While specific embodiments of the invention have been described in detail to illustrate the inventive principles, it will be understood that the invention may be embodied otherwise without departing from such principles.

I claim:

1. A continuous light-section or wire mill comprising, following an intermediate rolling section of the train, first and second finishing mill units operating independently of each other, wherein the first finishing mill unit is arranged in a first rolling line and the second finishing mill unit and a sizing mill unit are arranged in a second rolling line, the first rolling line branching off from the second rolling line and successively comprises a first horizontal looper following the first finishing mill section, a temperature equalization section extending in a reverse direction past the first finishing mill section, and a second horizontal looper following the temperature equalization section, and a second distributing guide connecting the first rolling line to the second rolling line in front of the second finishing mill unit, wherein the first rolling line extends parallel to the second rolling line, and wherein the second rolling line is followed by a rolling stock collecting device.

2. The light-section or wire mill according to claim 1, comprising a cooling section arranged in the second rolling line following the first distributing guide and in front of the finishing mill unit and the sizing mill unit, and two cooling sections arranged in the second rolling line following the finishing mill section and the sizing mill section.

3. The light-section or wire mill according to claim 1, comprising in the first rolling line a cooling section immediately following the first finishing mill unit and in front of the first looper and a cooling section following the looper and in front of the temperature equalization section.

4. The light-section or wire mill according to claim 1, further comprising shears arranged in the first and second rolling lines in front of the finishing mill units.

5. A method of operating a light-section or wire mill including, following an intermediate rolling section of the train, first and second finishing mill units operating independently of each other, wherein the first finishing mill unit is arranged in a first rolling line and the second finishing mill unit and a sizing mill unit are arranged in a second rolling line, the first rolling line branching off from the second rolling line and successively includes a first horizontal looper following the first finishing mill section, a temperature equalization section extending in a reverse direction past the first finishing mill section, and a second horizontal looper following the temperature equalization section, and a second distributing guide connecting the first rolling line to the second rolling line in front of the second finishing mill unit, wherein the first rolling line extends parallel to the second rolling line, and wherein the second rolling line is followed by a rolling stock collecting device, the method comprising introducing a rolled wire strand arriving from the intermediate rolling section initially through the first distributing guide into the first rolling line and into the first finishing mill unit, guiding the strand through the first and second loopers and the second distributing guide into the second rolling line, and finish-rolling the strand in the second finishing mill unit and the sizing mill unit.

6. A method of operating a light-section or wire mill including, following an intermediate rolling section of the train, first and second finishing mill units operating independently of each other, wherein the first finishing mill unit is arranged in a first rolling line and the second finishing mill unit and a sizing mill unit are arranged in a second rolling line, the first rolling line branching off from the second rolling line and successively includes a first horizontal looper following the first finishing mill section, a temperature equalization section extending in a reverse direction past the first finishing mill section, and a second horizontal looper following the temperature equalization section, and a second distributing guide connecting the first rolling line to the second rolling line in front of the second finishing mill unit, wherein the first rolling line extends parallel to the second rolling line, and wherein the second rolling line is followed by a rolling stock collecting device, the method comprising, for rolling thick wire dimensions, one of introducing a rolled wire strand arriving from the intermediate rolling section in a straight travel through the second rolling line and finish-rolling the strand in the second finishing mill unit and the sizing mill unit and introducing the rolled wire strand through the first distributing guide into the first rolling line, rolling the strand in the first finishing mill unit so as to reduce a cross-section of the strand, subsequently guiding the strand through the first and second loopers and the second distributing guide into the second rolling line, and, after a dummy pass through the second finishing mill unit, finish-rolling the strand in the sizing mill unit.

* * * * *